United States Patent [19]

Hasselqvist et al.

[11] 4,378,175

[45] Mar. 29, 1983

[54] POST MOUNTING

[75] Inventors: Stig E. A. Hasselqvist, Mjölby; P. Christer Helenelund, Linköping; Anders V. Thoreson, Rimforsa, all of Sweden

[73] Assignee: Handelsbolaget Scanovator, Linkoping, Sweden

[21] Appl. No.: 197,309

[22] PCT Filed: Dec. 8, 1978

[86] PCT No.: PCT/SE78/00091

§ 371 Date: Aug. 15, 1979

§ 102(e) Date: Aug. 15, 1979

[87] PCT Pub. No.: WO79/00391

PCT Pub. Date: Jul. 12, 1979

[30] Foreign Application Priority Data

Dec. 15, 1977 [SE] Sweden ..... 77142362

[51] Int. Cl.[3] ..... E04H 12/22; E01F 9/01; A63C 19/06

[52] U.S. Cl. ..... 404/10; 40/607; 52/298; 256/1; 256/13.1

[58] Field of Search ..... 248/500, 501, 502; 52/296, 297, 298; 256/13.1, 1; 403/2, 270, 271, 272, 264; 16/42 T, 42 R; 404/10

[56] References Cited

U.S. PATENT DOCUMENTS

| | | | |
|---|---|---|---|
| 2,141,067 | 12/1938 | Miller | 404/10 |
| 2,949,324 | 8/1960 | Birge et al. | 404/10 |
| 3,478,714 | 11/1969 | Keats | 404/10 |
| 3,693,940 | 9/1972 | Kendall et al. | 404/10 |

FOREIGN PATENT DOCUMENTS

| | | |
|---|---|---|
| 2306421 | 8/1974 | Fed. Rep. of Germany . |
| 2310717 | 9/1974 | Fed. Rep. of Germany . |
| 2428659 | 1/1976 | Fed. Rep. of Germany . |
| 2439142 | 2/1976 | Fed. Rep. of Germany . |

*Primary Examiner*—Stephen J. Novosad
*Attorney, Agent, or Firm*—Finnegan, Henderson, Farabow, Garrett & Dunner

[57] ABSTRACT

A yieldable assembly comprising a flange and post connected by elongated support means which allows the post to separate from the flange when struck by a vehicle but which retains connection therebetween. The support means yields under tensile strain and imparts a balanced restraining force to the vehicle after separation of the flange and post.

4 Claims, 14 Drawing Figures

Fig. 9
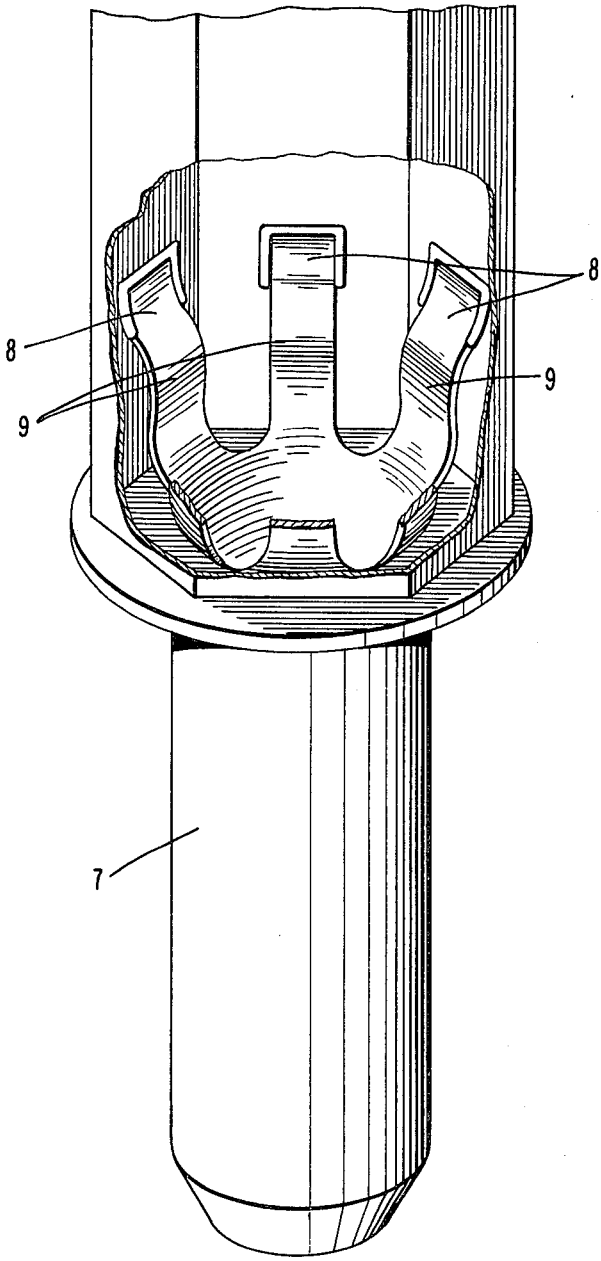
Fig. 10
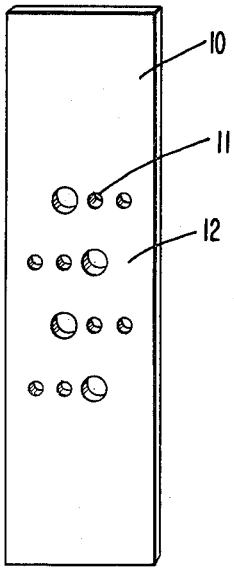
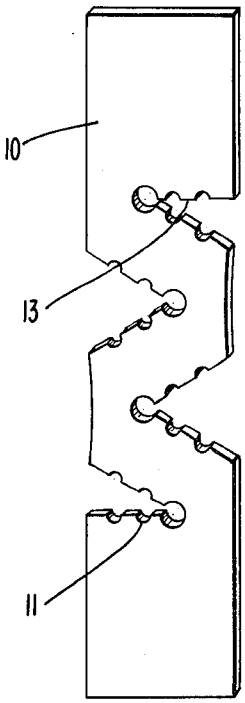
Fig. 11

POST MOUNTING

Posts for lighting and road signs at the side of the roads are exposed to the risk of being hit by vehicles. This relates to the road environment and its influence on damage in run-off accidents, for example. Lately, impact absorbing posts have been introduced, posts that are sufficiently soft or which break away and thereby reduce the collision forces that cause damage to road-users and vehicles.

It has, however, been observed that objects hit by a vehicle can damage following vehicles if the object is torn loose and flung about out of control. Furthermore, a driver who has just hit a post is most often so shocked that he can hardly steer the vehicle if it continues to move on. It would, therefore, be of great advantage if the object that was hit could relatively gently restrain the vehicle. The area of application could be expanded and eventually go so far as to the placing of such yielding and restraining posts along the central reservation of highways without a need for guard rails.

The present invention is a mounting device especially suited for yielding posts, for example lamp posts, but also suited for other posts located in the road environment.

The post mounting is in itself able to yield (either by means of short bent supports, or supports going through the post, or by means of an energy-absorbing attachment such as a friction attachment,) so that forces occurring when a vehicle hits the post become as small as possible.

Should a collision occur, the post casing becomes particularly heavily deformed at its base. Special measures are required to ensure that the post is not snapped off. The alternative of using a stronger design for the post itself is unsatisfactory, as the yielding of the post to the vehicle becomes too low. By anchoring the casing in supports or similar devices that in turn can yield under balanced resistance, it is possible to restrain both the post and the vehicle at the base of the post.

The following describes a flange mounting of the post. When hit, the casing of the post is bent by the vehicle to a flat shape along the ground, where the relatively thin shell of the casing splits and the post becomes partly or fully loosened at its base. The pre-shaped supports are fastened to the casing and readily follow the bending of the casing, but provide resistance when they are stretched lengthwise. They can therefore be designed to retain the post at its base even after the casing has been torn off by the vehicle.

The supports serve as an anchoring device between the foundation and the torn-off post, with the result that both the post and the vehicle hitting it are retained.

A variation of the energy-absorbing support can be obtained by using a tie plate perforated in a certain pattern. The pattern is made allowing the plate to be torn crosswise in certain parts, not completely, but so that untorn sections of the material retain the post at its base. This effect can for example be obtained by making rows of holes across the tie plate and alternatively omitting the last hole or holes in each row, so that no rupture of the material occurs at these points. The distance between the edges of the holes is relatively small and the plate breaks there when strained. A zig-zag shaped rupture pattern occurs. By adjusting the accumulation of material, it is possible in this manner to obtain supports that moderate forces. Slots can be punched in the material instead of the rows of holes. The tie plate can furthermore be designed as a tube-shaped support along the whole of the inside of the post.

FIGS. 6–9 show supports for mounting a post set in a foundation.

FIG. 10 shows a support device with perforated tie plate.

FIG. 11 shows an expanded support (as in FIG. 10).

Figure 1A:
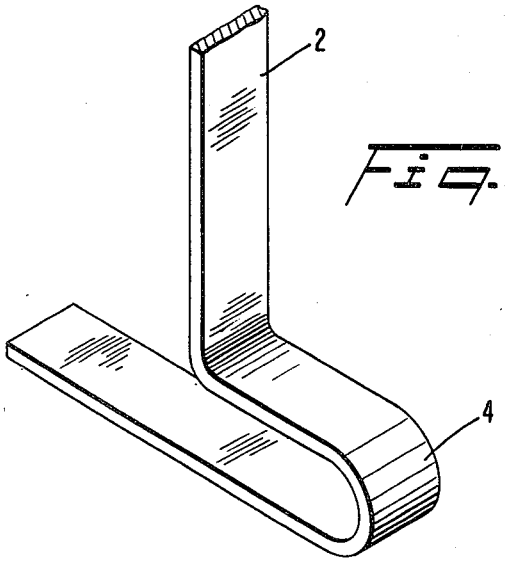
FIGS. 1–5 show supports for the connection between a flange 1 and the base of a post 3.
Figure 1B:
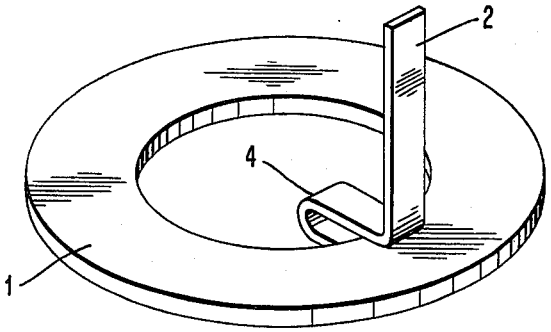
Figure 1C:
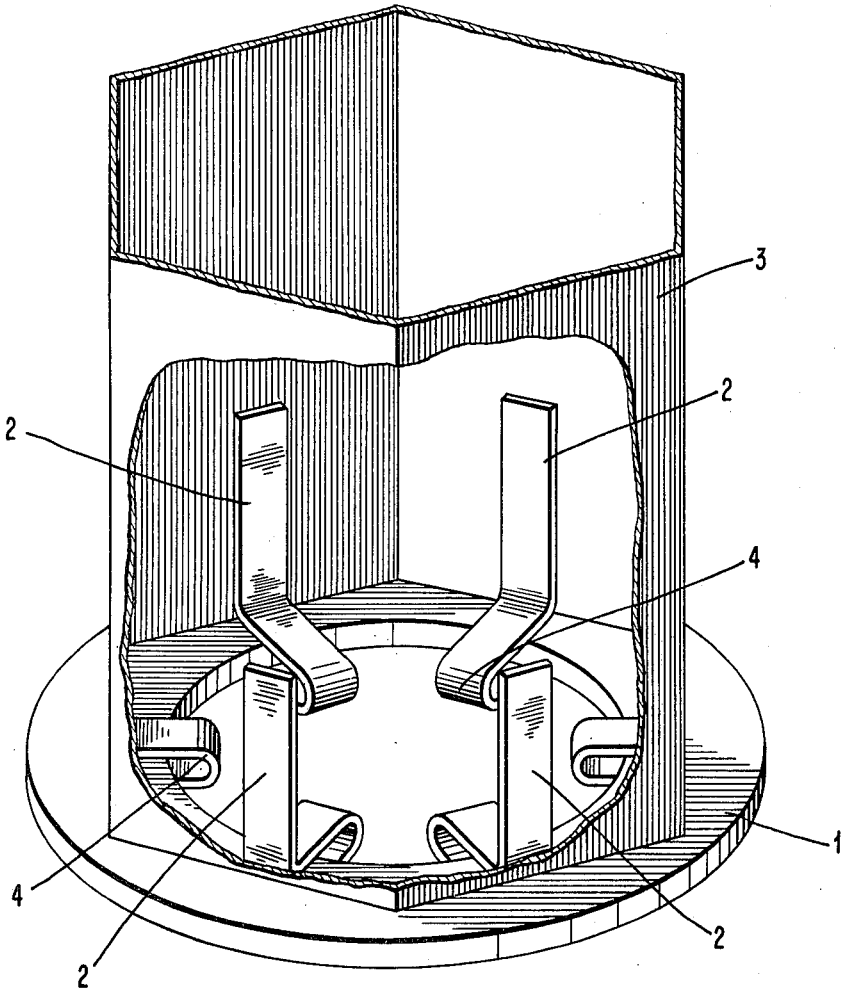

FIG. 1 shows supports 2 fabricated from steel straps which are then welded to the inside of the casing at their upper ends and to the underside of the flange at their lower ends. The support is formed with a special bend 4, in accordance with the concept of the invention. FIG. 1*a* shows an individual support 2. FIG. 1*b* shows a support mounted on the flange 1 and FIG. 1*c* shows six supports mounted in a post.

Figure 2:
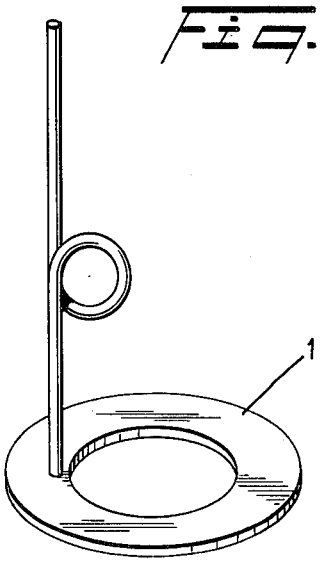
Figure 3:
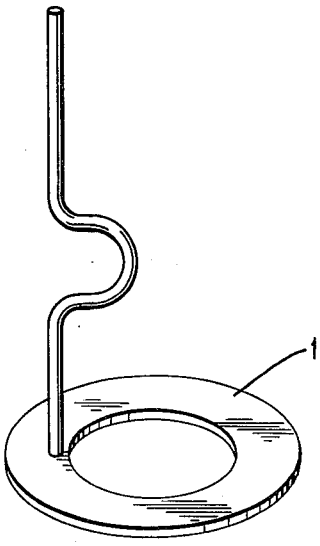
Figure 4:
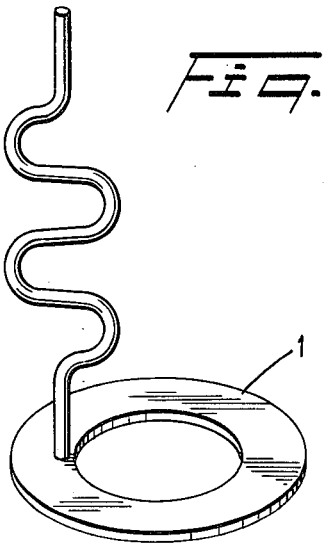

FIGS. 2–4 show variations of the shaping of supports in the form of iron rods, fastened at one end to the inside of the casing and at the other in special holes in the flange.

Figure 5:
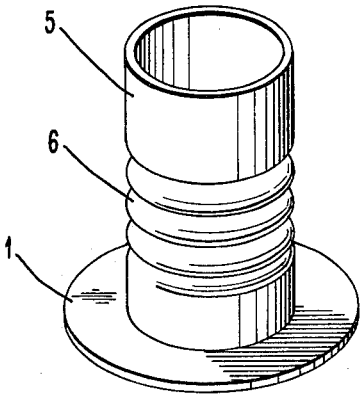

FIG. 5 shows a variation consisting of a relatively thin tube 5 which is pressed together in its axial direction as a bellows 6. It is then fastened to the inside of the casing and to the flange. Its energy-absorbing capacity is based on stretching of the tube in its axial direction.

Figure 6:
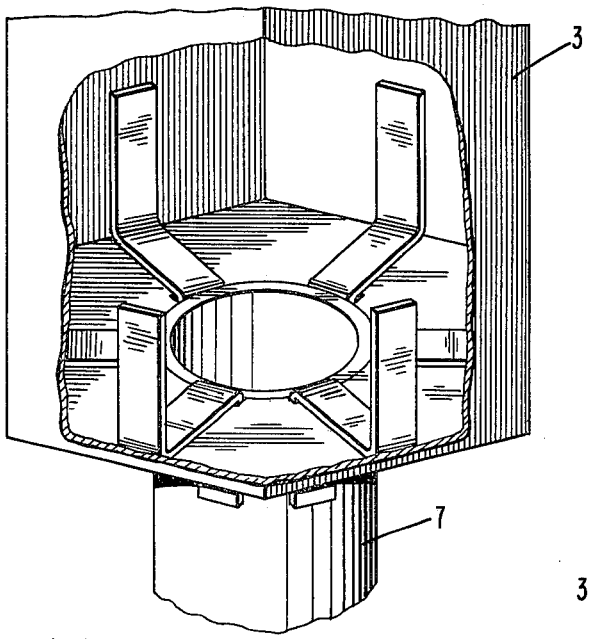

FIG. 6 shows the same type of support as in FIG. 1. The post is, however, not provided with a flange, but is intended for bedding in a foundation. The supports are therefore fastened to a section 3 above ground on the casing, and a section 7 below the ground, and are bent in one or more curves between these sections.

Figure 8:
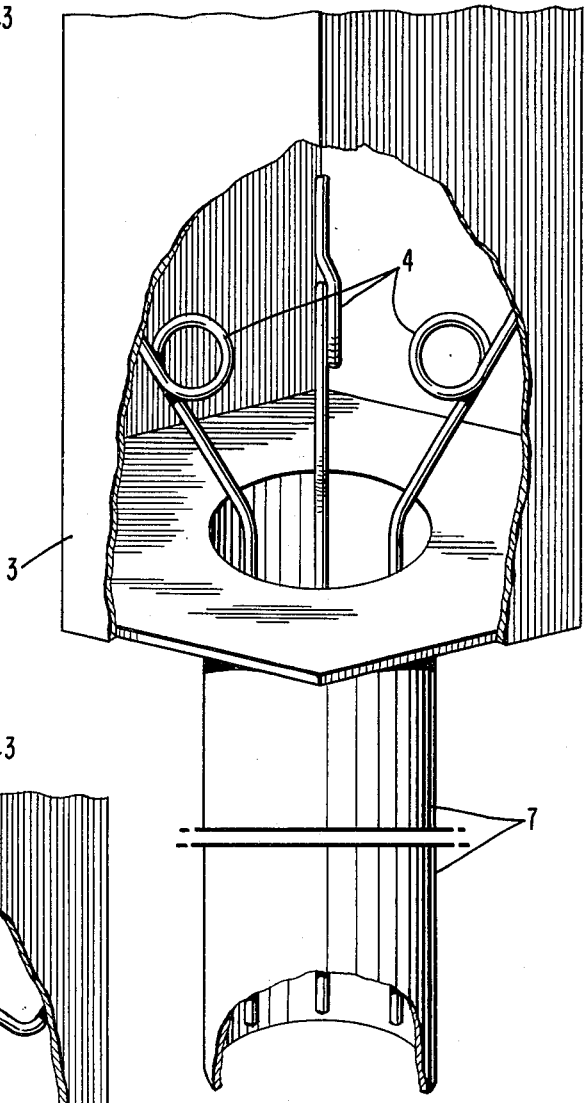
Figure 7:
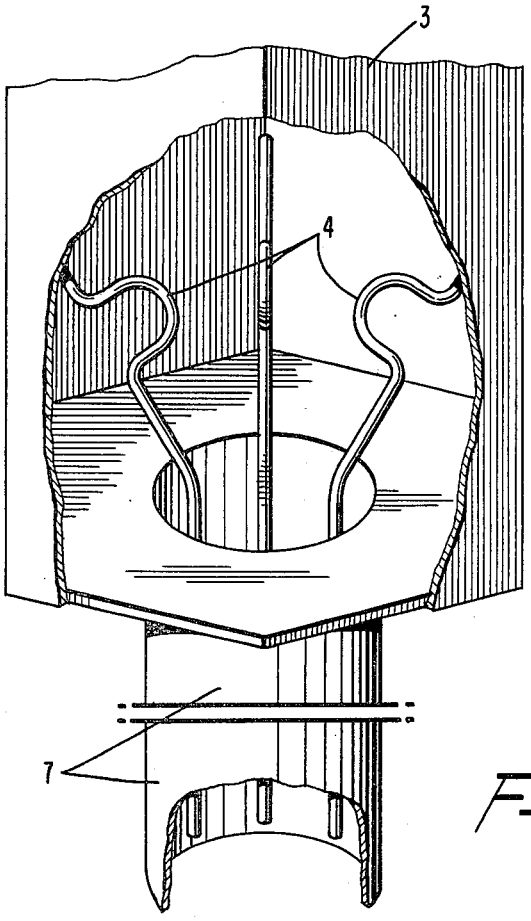

FIGS. 7–8 show designs corresponding to FIG. 6, but using rod supports.

FIG. 9 shows the same design as in FIG. 5, but with a compressed, slotted tube fastened to a section above ground and to a section below ground. The tube is formed with support arms 8 having special bends 9.

FIG. 10 shows a support device with tie plate 10 and rows of holes 11 which have the last hole omitted alternately. This provides a greater amount of material 12 at those points. The rows of holes can be replaced by slots.

FIG. 11 shows a support which has been stretched as the result of an accident. The material 13 between the rows of holes has ruptured, except at point 12 where the material was more solid. The tie plate has been stretched and constitutes an energy-absorbing anchor between the foundation and the casing of the post.

Figure 12:
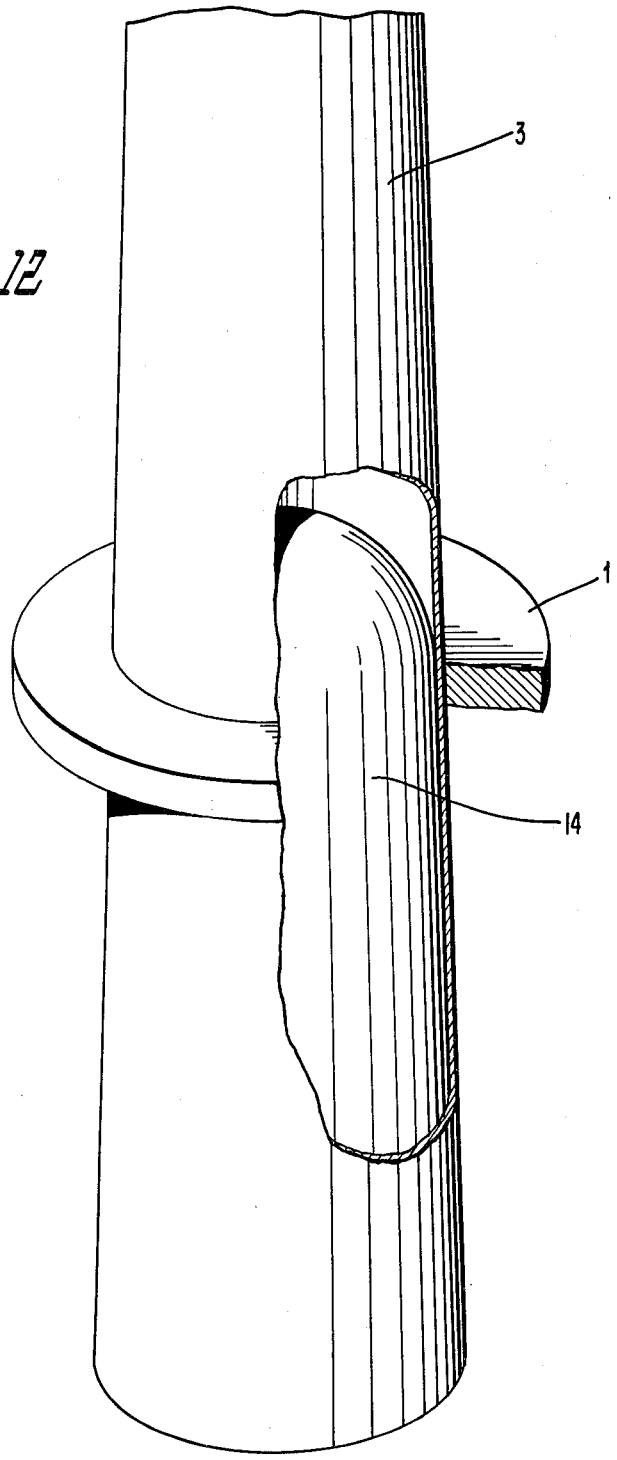
FIG. 12 shows a friction attachment at the foundation.

FIG. 12 shows an example of a post support with a continuous casing extending to the bottom of the foundation. The casing 3 of the post is slightly tapered and when stretched, an interaction occurs between the flange 1 and a core 14 set in the foundation.

The designs shown here are by no means the only ones satisfying the concept of the invention. Variations can be made, for example, the supports can be located on the outside of the casing, they can be fastened by screw connections so that an energy-absorbing effect is obtained by means of friction, or they can be provided with some sort of springs dimensioned for the purpose.

We claim:

1. A yieldable assembly comprising a flange, a post extending upwardly from said flange, elongated support means fixed to said flange and said post, said support means being yieldable to allow said post to separate from said flange upon being struck, for example, by a vehicle, said support means being formed to yield under tensile strain thereby serving to retain connection between said post and said flange after separation therebetween, and serving to impart a balanced restraining force to said vehicle after separation.

2. An assembly as claimed in claim 1, said support means including a plurality of metal straps joined at opposite ends to said post and flange, said straps having an intermediate portion formed with a bend extending laterally of said post.

3. An assembly as claimed in claim 1, said support means being metallic and fixed at opposite ends to said post and said flange and having an intermediate portion bent or deformed laterally of said post.

4. An assembly as claimed in claim 1, said support means being formed with one or more specifically designed deformations which tend to be straightened when tension forces are applied lengthwise of said support means, thereby providing an energy absorbing attachment between said post and said flange.

* * * * *